United States Patent [19]

Keough et al.

[11] Patent Number: 4,528,032

[45] Date of Patent: Jul. 9, 1985

[54] LITHIUM PURIFICATION TECHNIQUE

[75] Inventors: Robert F. Keough; George E. Meadows, both of Richland, Wash.

[73] Assignee: The United States of America as represented by the United States Department of Energy, Washington, D.C.

[21] Appl. No.: 569,698

[22] Filed: Jan. 10, 1984

[51] Int. Cl.[3] ..... C22B 26/10

[52] U.S. Cl. ..... 75/66

[58] Field of Search ..... 75/66

[56] References Cited

U.S. PATENT DOCUMENTS 1,559,342 10/1925 Mattice ..... 75/66
1,802,693 4/1931 Anderson ..... 75/66
2,997,289 8/1961 Baker ..... 75/66
4,003,560 1/1977 Carbonnel ..... 75/93 E

*Primary Examiner*—Peter D. Rosenberg
*Attorney, Agent, or Firm*—Edward W. Nypaver; Robert Southworth, III; Judson R. Hightower

[57] ABSTRACT

A method for purifying liquid lithium to remove unwanted quantities of nitrogen or aluminum. The method involves precipitation of aluminum nitride by adding a reagent to the liquid lithium. The reagent will be either nitrogen or aluminum in a quantity adequate to react with the unwanted quantity of the impurity to form insoluble aluminum nitride. The aluminum nitride can be mechanically separated from the molten liquid lithium.

5 Claims, No Drawings

LITHIUM PURIFICATION TECHNIQUE

The U.S. Government has rights in this invention pursuant to Contract De-AC06-76FF02170 between the U.S. Department of Energy and Westinghouse Electric Corporation.

BACKGROUND OF THE INVENTION

The present invention relates to purification of liquid lithium for removal of unwanted quantities of dissolved nitrogen or aluminum. According to the disclosure, the impurities are precipitated from the lithium as aluminum nitride.

Liquid lithium has been proposed as the working coolant in fusion reactors and related test facilities. It is expected that stainless steel will be the primary lithium containment material. This disclosure is directed to the resulting corrosion problems that are anticipated in such facilities. While even pure lithium exhibits some corrosive effects on stainless steel, these effects are greatly accentuated and changed in nature by the presence of certain lithium impurities, particularly dissolved quantities of carbon and nitrogen. Dissolved nitrogen is of the greatest concern because of its high solubility in lithium and the ease of contamination of the lithium by contact with surrounding air.

The effects of nitrogen on corrosion of stainless steel by lithium has been previously documented by researchers. They have found that corrosion effects are influenced by the nitrogen concentration. High nitrogen levels typically lead to general dissolution and intergranular penetration in the stainless steel structure. It appears that the primary attack is via chromium, which forms a ternary nitride, $Li_9CrN_5$. To maintain lithium at an acceptable corrosion level, it appears essential to keep its dissolved nitrogen content below about 100 ppm.

Aluminum can also be a major impurity in commercial grade lithium. It carries over from the lithium ore. Dissolved quantities of aluminum in liquid lithium are not known to cause corrosion in stainless steel or other potential containment metals. However, in the presence of dissolved aluminum, subsequent contamination of the liquid lithium by nitrogen results in the formation of a solid phase (aluminum nitride) which might settle as a sludge or deposit. This solid material can inhibit lithium flow characteristics or plug small flow paths. It also will adversely affect heat transfer capabilities of the liquid lithium.

The present method comprises a chemical system for removing aluminum or nitrogen from liquid lithium prior to or during its use.

Prior U.S. Pat. No. 1,559,342 to Mattice describes attempts to purify molten metal by the use of aluminum. It does not identify the impurities removed by the aluminum, nor does it describe the specific molten metal that is being purified. It relates to an improved technique of adding lime, borax and aluminum. The reaction forms a slag which can be easily separated from the molten metal.

Prior U.S. Pat. Nos. 1,802,693 to Anderson, and 4,003,560 to Carbonnel each disclose methods for removing impurities from a metal by bubbling nitrogen through the molten metal. Both are primarily directed to purification of molten aluminum. The nitrogen apparently does not react with the aluminum, but only with the unidentified impurities which are removed from it.

U.S. Pat. No. 2,997,289 to Baker et al is of background interest in that it describes an apparatus for producing lithium metal and separating the lithium from barium.

SUMMARY OF THE INVENTION

It is an object of this invention to effectively remove dissolved nitrogen or aluminum from liquid lithium prior to or during use of the liquid lithium as a coolant.

Additional objects, advantages and novel features of the invention will be set forth in part in the description which follows, and in part will become apparent to those skilled in the art upon examination of the following, or may be learned by practice of the invention. The objects and advantages of the invention may be realized and attained by means of the instrumentalities and combinations particularly pointed out in the appended claims.

To achieve the foregoing and other objects, and in accordance with the purpose of the present invention as embodied and broadly described herein, the mehtod of this invention comprises addition of a reagent to precipitate aluminum or nitrogen in the liquid lithium as aluminum nitride. When the resulting solid materials can be accommodated by the mechanical system in which the liquid lithium is used, a precautionary quantity of reagent can be added to the liquid lithium prior to its use.

DETAILED DESCRIPTION OF THE INVENTION

This disclosure is concerned with the removal of aluminum or nitrogen from liquid lithium by the balanced addition of a reagent (nitrogen for removal of aluminum, aluminum for removal of nitrogen). The use of excess reagent acts as a "soluble getter" to control subsequent contamination of the liquid lithium. While it is effective during use of the liquid lithium as a coolant, it does require that the coolant system be mechanically designed to accommodate the resulting formation of sludge or solid deposits that result from precipitation of aluminum nitride. This might require inclusion of a settling tank or filter system within the coolant recirculation system.

We became aware of the ability of aluminum to control dissolved nitrogen in liquid lithium in the course of experiments where air inadvertently entered the liquid lithium system. Despite this contamination, we found that the nitrogen content of the liquid lithium remained much lower than expected, even though there was no purification system in operation to remove the nitrogen. However, we also noted that the aluminum content of the lithium was decreased. The explanation of these observations was that aluminum nitride was probably being formed in the liquid lithium. We recognized this as a "soluble getter" effect.

A bench scale experiment was subsequently carried out in which nitrogen gas was added to liquid lithium. Again, we found that dissolved nitrogen in the lithium remained at about 15 ppm even after several hundred ppm of nitrogen had been added to the liquid lithium. Once more, we discovered that the dissolved aluminum in the liquid lithium decreased after addition of the nitrogen. We isolated and analyzed the reaction product and found it to be aluminum nitride.

These experiments have been repeated several times, and it has been confirmed that the presence of aluminum in the liquid lithium is an effective reagent in forming a precipitate for removal of the undesirable contaminant. By this method, it is practical to maintain the dissolved nitrogen in the liquid lithium at levels substantially below 100 ppm.

The present method for purification of liquid lithium by precipitation of aluminum nitride formed from an unwanted quantity of an impurity in the form of either aluminum or nitrogen present in the liquid lithium requires the addition of a reagent in the form of a stoichiometric quantity of either nitrogen or aluminum to react with the unwanted quantity of impurity to form insoluble aluminum nitride. Intimate mixing of the solvent (liquid lithium), the impurity (aluminum or nitrogen) and the reagent (nitrogen or aluminum) is necessary in order to permit the reaction to be completed. In most instances it will also be desirable to assure that the resulting precipitate is mechanically separated from the liquid lithium.

The technique for the removal of aluminum or nitrogen from metallic liquid lithium is based on the findings that: (1) aluminum nitride preferentially forms when both aluminum and nitrogen are present in molten lithium and (2) the resulting aluminum nitride is insoluble in molten lithium. It is therefore possible to precipitate either of these common lithium impurities by adding a stoichiometric quantity or more of the other. The resulting aluminum nitride particles are relatively dense and can be removed by conventional techniques. The removal of the particles is not necessary to achieve the same reduction in thermodynamic chemical activity of the impurity.

In some applications, the maintenance of a modest concentration of the more tolerable impurity can be used to quickly react the less tolerable impurity if inadvertent contamination occurs. The reagent can be added to the liquid lithium in anticipation of its subsequent contamination by the impurity during use of the liquid lithium.

In compliance with the statute, the invention has been described in language more or less specific to the method. It is to be understood, however, that the invention is not limited to the specific details described, since the method comprises a preferred form of utilizing the system. The invention is, therefore, claimed in any of its forms or modifications within the proper scope of the appended claims, appropriately interpreted in accordance with the doctrine of equivalents.

We claim:

1. A method for purification of liquid lithium by precipitation of aluminum nitride formed from an unwanted quantity of an impurity in the form of either aluminum or nitrogen present in the liquid lithium, comprising the following steps:

adding a reagent to the liquid lithium in the form of a stoichiometric quantity of either nitrogen or aluminum to react with the unwanted quantity of impurity in the form of either aluminum or nitrogen, respectively, to form insoluble aluminum nitride;

permitting the reaction to continue until completed; and separating the resulting precipitate of aluminum nitride from the liquid lithium.

2. The method of claim 1 wherein the impurity is nitrogen and aluminum is added to the liquid lithium.

3. The method of claim 1 wherein the impurity is aluminum and nitrogen is added to the liquid lithium.

4. The method of claim 1 wherein the reagent is added to the liquid lithium in anticipation of its subsequent contamination by the impurity during use of the liquid lithium.

5. The method of claim 1 including settling the resulting precipitate of aluminum nitride in preparation for its subsequent separation from the liquid lithium.

* * * * *